US008720210B2

(12) United States Patent
Xu

(10) Patent No.: US 8,720,210 B2
(45) Date of Patent: May 13, 2014

(54) VIBRATION-INHIBITING REINFORCEMENT MEMBER FOR A CRYOCOOLER

(75) Inventor: Mingyao Xu, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 1168 days.

(21) Appl. No.: 11/896,980

(22) Filed: Sep. 7, 2007

(65) Prior Publication Data

US 2008/0276626 A1 Nov. 13, 2008

(30) Foreign Application Priority Data

May 8, 2007 (JP) ..... 2007-123629

(51) Int. Cl.
*F25B 9/00* (2006.01)
*F25B 9/14* (2006.01)

(52) U.S. Cl.
CPC .. *F25B 9/145* (2013.01); *F25B 9/14* (2013.01)
USPC ..... 62/6

(58) Field of Classification Search
CPC ..... F25B 9/145; F25B 9/14
USPC ..... 62/6
See application file for complete search history.

(56) References Cited

U.S. PATENT DOCUMENTS 4,848,092 A * 7/1989 Gifford ..... 62/6
4,854,131 A * 8/1989 Sakitani et al. ..... 62/51.2
5,139,242 A * 8/1992 Yarr ..... 267/160
5,327,733 A * 7/1994 Boolchand et al. ..... 62/51.1
5,845,498 A * 12/1998 Matsui et al. ..... 62/6
6,196,005 B1 * 3/2001 Stautner ..... 62/6
6,196,006 B1 * 3/2001 Kawano et al. ..... 62/6
6,343,475 B1 * 2/2002 Ishikawa ..... 62/6
2001/0005165 A1 * 6/2001 Laskaris et al. ..... 335/299
2005/0005613 A1 * 1/2005 Atrey et al. ..... 62/6
2005/0103025 A1 * 5/2005 Stautner et al. ..... 62/6
2005/0126187 A1 * 6/2005 Li et al. ..... 62/6
2005/0229620 A1 * 10/2005 Kirichek et al. ..... 62/295

FOREIGN PATENT DOCUMENTS

EP 0 905 435 A2 3/1999
JP 11-182959 A 7/1999
JP 2004-093062 A 3/2004
JP 2005-024184 A 1/2005
JP 2005-172597 A 6/2005
WO WO-03/036207 A2 5/2003

OTHER PUBLICATIONS

JPO Office Action, App. No. 2007-123629, Mar. 31, 2009 (2 pages).

* cited by examiner

*Primary Examiner* — Allen Flanigan
*Assistant Examiner* — Filip Zec
(74) *Attorney, Agent, or Firm* — Rader, Fishman & Grauer PLLC

(57) ABSTRACT

A regenerative cryocooler, the regenerative cryocooler being connected to a compressor configured to make coolant gas have a high pressure, send the high pressure coolant gas, and absorb coolant gas having a low pressure, the regenerative cryocooler includes a cooling stage having a regenerative material and connected to a cylinder member, the cylinder member being where the coolant gas flows, the coolant gas repeating compression and expansion; and a reinforcing member configured to prevent vibration of the cooling stage.

11 Claims, 5 Drawing Sheets

VIBRATION-INHIBITING REINFORCEMENT MEMBER FOR A CRYOCOOLER

BACKGROUND OF THE INVENTION

1. Field of the Invention

The present invention generally relates to regenerative cryocoolers and pulse tube cryocoolers, and more specifically, to a regenerative cryocooler, such as a pulse tube cryocooler, configured to cool a subject to be cooled at a cryogenic temperature.

2. Description of the Related Art

Conventionally, regenerative cryocoolers such as pulse tube cryocoolers or GM (Gifford-McMahon) cryocoolers have been used in order to cool apparatuses requiring cryogenic temperature atmospheres such as MRI (magnetic resonance imaging) apparatuses.

In the regenerative cryocooler, it is possible to form a state from the cryogenic temperature of approximately 4 K to the low temperature of approximately 100 K. For example, in the pulse tube cryocooler, a cooling effect is formed at low temperature ends of the regenerator tube and the pulse tube by repeating an operation for letting coolant gas compressed by a gas compressor flow in the regenerator tube and the pulse tube and an operation for receiving working gas in the gas compressor by letting the gas out from the regenerator tube and the pulse tube. In addition, by making these low temperature ends come in thermal contact with the subject to be cooled, it is possible to remove heat from the subject to be cooled.

The regenerator tube of the pulse tube cryocooler has a cylinder. A regenerative material fills the cylinder. The pulse tube is formed by a hollow cylinder. These cylinders have high temperature ends and low temperature ends. A cooling stage is provided at the low temperature end of the cylinder. The subject to be cooled is connected to this cooling stage.

If the amount of heat entering from the peripheral atmosphere to the high temperature end of the cylinder becomes large, the temperature at the low temperature end rises so that the cooling capacity of the cryocooler is degraded.

Because of this, in order to reduce heat transfer between the peripheral atmosphere and the high temperature end, it is suggested to make the walls of the cylinders forming the regenerator tube and the pulse tube thin.

In a case where the cylinders are made thinner, the cylinder is stretched in an axial direction due to repeating of compression and expansion of the coolant gas flowing inside. As a result of this, the cooling stage connected to the low temperature end of the cylinder may be vibrated.

In addition, due to such vibration of the cooling stage, a position of the subject to be cooled provided at the cooling stage may be changed. The change of the position of the subject to be cooled may be a serious problem in an apparatus such as a semiconductor manufacturing apparatus requiring positioning with high precision.

Because of this, in order to prevent the position change of the subject to be cooled due to vibration of the cooling stage, it is suggested to provide a vibration prevention apparatus at the cryocooler such as the pulse tube cryocooler. See, for example, Japanese Laid-Open Patent Application No. 2005-24184.

The vibration prevention apparatus discussed in Japanese Laid-Open Patent Application No. 2005-24184 has a second flange configured to support a subject to be cooled, separate from a normal support flange configured to support cylinders of the pulse tube and the regenerator tube.

A low vibration stage coming in contact with the subject to be cooled is supported at the second flange via a supporting stick. In addition, the cooling stage and the low vibration stage are thermally and mechanically connected to each other via a heat link, namely a flexible high thermal conductivity wire. The normal support flange and the second flange are connected to each other via a vibration absorption member such as a bellows. Because of such a vibration prevention apparatus, it is possible to prevent the vibration generated by the cylinder of the cryocooler from being transferred to the subject to be cooled.

However, in a case where the vibration prevention apparatus discussed in Japanese Laid-Open Patent Application No. 2005-24184 is provided, since the heat link is a wire having a small cross section, even if the heat link is made of a high thermal conductivity wire such as copper or aluminum, it is not possible to completely remove thermal resistance generated at the heat link.

Accordingly, in a method for thermally connecting the cooling stage and the low vibration stage (or the subject to be cooled) via the heat link, considering a case where the cooling stage and the subject to be cooled directly come in contact with each other, the cooling capacity of the cryocooler may be degraded.

In addition, if the vibration prevention apparatus is additionally provided, the structure of the cryocooler may be complex so that it is difficult to make the size of the cryocooler small.

SUMMARY OF THE INVENTION

Accordingly, embodiments of the present invention may provide a novel and useful regenerative cryocooler and pulse tube cryocooler solving one or more of the problems discussed above.

More specifically, the embodiments of the present invention may provide a regenerative cryocooler, such as a pulse tube cryocooler, whereby good cooling capacity can be achieved and vibration of a cooling stage can be prevented without making it complex and large.

One aspect of the present invention may be to provide a regenerative cryocooler, the regenerative cryocooler being connected to a compressor configured to make coolant gas have a high pressure, send the high pressure coolant gas, and absorb coolant gas having a low pressure, the regenerative cryocooler including:

a cooling stage having a regenerative material and connected to a cylinder member, the cylinder member being where the coolant gas flows, the coolant gas repeating compression and expansion; and a reinforcing member configured to prevent vibration of the cooling stage.

Another aspect of the present invention may be to provide a pulse tube cryocooler, including:

a compressor configured to make coolant gas have a high pressure, send the high pressure coolant gas, and absorb coolant gas having a low pressure;

a pulse tube where the coolant gas flows, the coolant gas repeating compression and expansion; and a reinforcing member configured to prevent vibration of a cooling stage connecting a regenerator tube and the pulse tube.

Other objects, features, and advantages of the present invention will become more apparent from the following detailed description when read in conjunction with the accompanying drawings.

DETAILED DESCRIPTION OF THE PREFERRED EMBODIMENTS

A description is given below, with reference to the FIG. 1 through FIG. 5 of embodiments of the present invention.

[First Embodiment]

Figure 1:
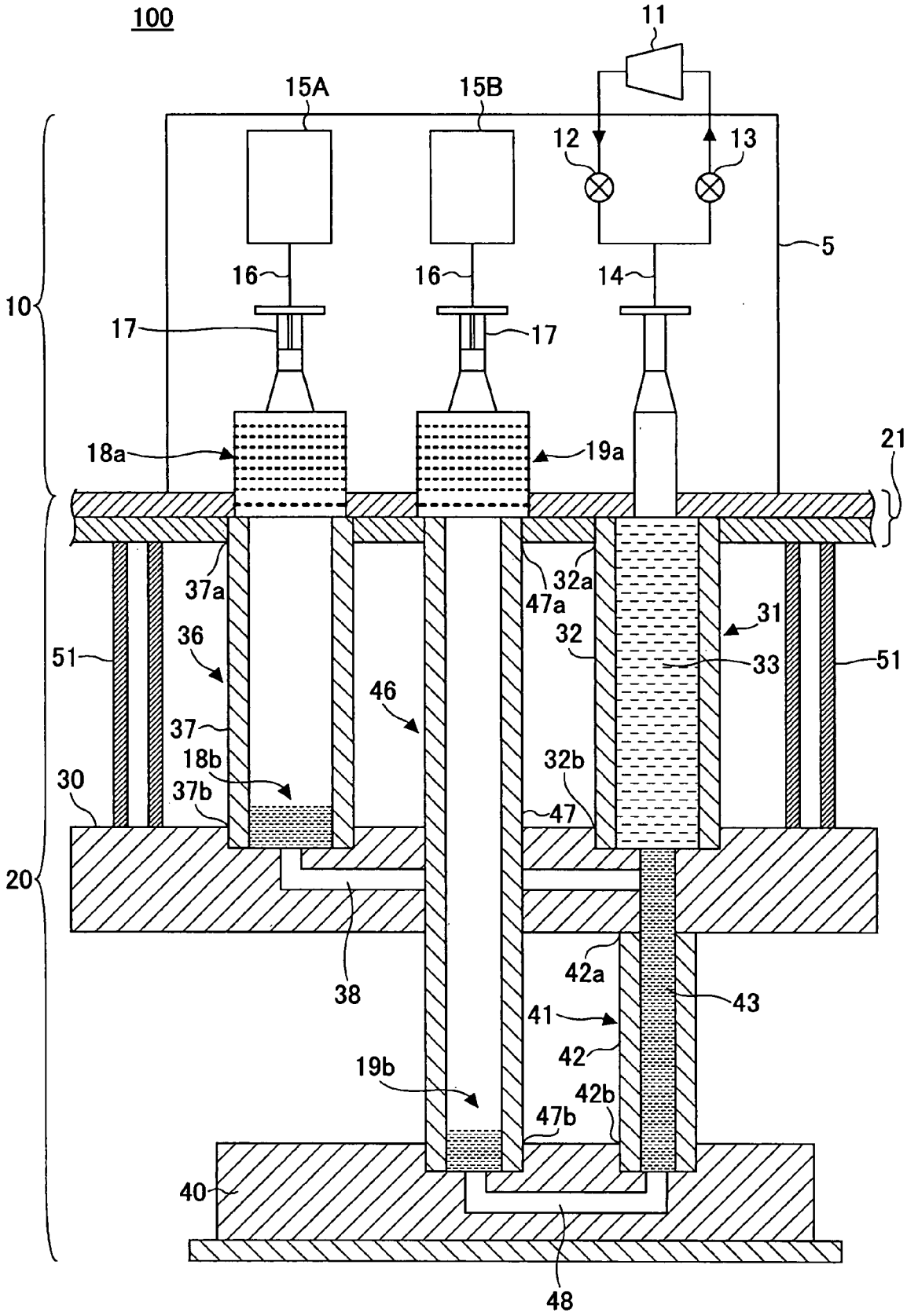
FIG. 1 is a schematic structural view of a two-stage type pulse tube cryocooler of a first embodiment of the present invention.

FIG. 1 is a schematic structural view of a two-stage type pulse tube cryocooler of a first embodiment of the present invention. A pulse tube shown in FIG. 1 is a two-stage type pulse tube cryocooler.

Referring to FIG. 1, a two-stage type pulse tube cryocooler 100 includes a housing part 10, a gas compressor 11, and a cold head part 20. The cold head part 20 is connected to the housing 10 via a flange 21.

The gas compressor 11 is configured to let coolant gas, such as helium gas with a high pressure at a designated cycle, flow into the housing part 10 and the cold head part 20 and exhaust the gas at a low pressure.

The housing part 10 includes a housing 5. A first stage reservoir 15A, a second stage reservoir 15B, heat exchangers 18*a* and 19*a*, an intake valve 12, an exhaust valve 13, an orifice 14, and others are received in the housing 5. The intake valve 12 and the exhaust valve 13 are connected to the gas compressor 11 via a gas pipe 14. The housing 5 is made of, for example, aluminum or an aluminum alloy.

The cold head part 20 includes a first stage regenerator tube 31, a first stage pulse tube 36, and a second stage pulse tube 46 which are fixed to the flange 21, a first stage cooling stage 30, a second stage regenerator tube 41, and a second stage cooling stage 40.

The first stage regenerator tube 31 includes a hollow cylinder 32 and a regenerative material 33. The cylinder is made of, for example, stainless steel. The regenerative material 33 is formed by a metal mesh made of copper or stainless steel filling the cylinder 32. The first stage pulse tube 36 includes a hollow cylinder made of, for example, stainless steel.

High temperature ends 32*a* and 37*a* of these cylinders 32 and 37, respectively, come in contact with and are fixed to the flange 21. Low temperature ends 32*b* and 37*b* of these cylinders 32 and 37, respectively, come in contact with and are fixed to the first cooling stage 30.

A gas flow path 38 is formed in the first stage cooling stage 30. The low temperature end 37*b* of the first stage pulse tube 36 and the low temperature end 32*b* of the first stage regenerator tube 31 are connected to each other via the heat exchanger 18*a* and the gas flow path 38. The first stage cooling stage 30 is thermally and mechanically connected to a subject to be cooled (not shown in FIG. 1) so that a cooling effect is taken out to the subject to be cooled.

In addition, the second stage regenerator tube 41 includes a hollow cylinder 42 filled with a regenerative material 43. The cylinder 42 is made of, for example, stainless steel. The regenerative material 43 is formed by a metal mesh made of copper or stainless steel filling the cylinder 42. The second stage pulse tube 46 includes a hollow cylinder 47 made of, for example, stainless steel.

A high temperature end 42*a* of the cylinder 41 of the second stage regenerator tube 42 comes in contact with and is fixed to the first stage cooling stage 30. A low temperature end 42*b* of the cylinder 42 of the second stage regenerator tube 41 comes in contact with and is fixed to the second stage cooling stage 40.

A high temperature end 47*a* of the cylinder 47 of the second stage pulse tube 46 comes in contact with and is fixed to the flange 21. A low temperature end 47*b* of the cylinder 47 of the second stage pulse tube 46 comes in contact with and is fixed to the second stage cooling stage 40.

A gas flow path 48 is formed in the second stage cooling stage 40. The low temperature end 47*b* of the second stage pulse tube 46 and the low temperature end 42*b* of the second stage regenerator tube 41 are connected to each other via a heat exchanger 19*b* and the gas flow path 48. The second stage cooling stage 40 is thermally and mechanically connected to a subject to be cooled (not shown in FIG. 1) so that a cooling effect is taken out to the subject to be cooled.

In the pulse tube cryocooler 100, the high pressure coolant gas is supplied from the gas compressor 11 to the first stage regenerator tube 31 via the suction valve 12 and the gas flow path 14. In addition, the low pressure coolant gas is supplied from the first stage regenerator tube 31 to the gas compressor 11 via gas flow path 14 and an exhaust valve 13.

A first stage reservoir 15A is connected to the high temperature end 37*a* of the first stage pulse tube 36 via the heat exchanger 18*a* and the orifice 17. In addition, a second stage reservoir 15B is connected to the high temperature end 47*a* of the second stage pulse tube 46 via the heat exchanger 19*a* and the orifice 17. At the first stage pulse tube 36 and the second stage pulse tube 46, the orifices control difference of phases between pressure change and volume change of the coolant gas periodically changing.

Next, operations of the pulse tube cryocooler 100 having the above-discussed structure are discussed.

First, when the suction valve 12 becomes open and the exhaust valve 13 becomes closed, high pressure coolant gas flows from the gas compressor 11 to the first stage regenerator tube 31. While the coolant gas is cooled by the regenerative member 33 so that the temperature of the coolant gas is decreased, the coolant gas passes through the gas flow path 38 from the low temperature end 32*b* so as to flow inside the first stage pulse tube 36.

Low pressure coolant gas already existing inside the first stage pulse tube 36 is compressed by the flowing high pressure coolant gas, so that the pressure of the low pressure coolant inside the first stage pulse tube 36 becomes higher than that inside the first stage reservoir 15A and the low pressure coolant gas passes through the orifice 17 and the gas flow path 16 and flows into the first stage reservoir 15A.

A part of the high pressure coolant gas cooled by the first stage regenerator tube 31 flows into the second stage regenerator tube 41. The part of the high pressure coolant gas is further cooled by the regenerative member 43 so that the temperature of the part of the high pressure coolant gas is decreased. The part of the high pressure coolant gas passes through the gas flow path 48 from the low temperature end 42*b* of the second regenerator tube 41 and flows inside the second stage pulse tube 46.

Low pressure coolant gas already existing inside the second stage pulse tube 46 is compressed by the flowing high pressure coolant gas, so that the pressure of the low pressure coolant inside the second stage pulse tube 46 becomes higher than that inside the second stage reservoir 15B and the low pressure coolant gas passes through the orifice 17 and the gas flow path 16 and flows into the second stage reservoir 15B.

When the suction valve 12 becomes closed and the exhaust valve 13 becomes open, the coolant gas in the first stage pulse tube 36 and the second stage pulse tube 46 passes through the first stage regenerator tube 31 and the second stage regenerator tube 41 while the gas cools the regenerative members 33 and 43. In addition, the coolant gas passing through the second stage regenerator tube 41 passes through the first stage regenerator tube 31.

After that, the coolant gas passes through the exhaust valve 13 from the high temperature end 32*a* of the first stage regenerator tube 31 so as to return to the gas compressor 11.

The first stage pulse tube 36 and the second stage pulse tube 46 are connected to the first stage reservoir 15A and the second stage reservoir 15B via the orifices 17. Accordingly, a phase of pressure change and a phase of volume change of coolant gas occur with a constant phase difference.

Based on this phase difference, a cooling effect due to expansion of coolant gas is generated at the low temperature end 37*b* of the first stage pulse tube 36 and the low temperature end 47*b* of the second pulse tube 46. By repeating these operations, the pulse tube cryocooler 100 works as a cryocooler.

It is normal practice that the cylinder 32 of the first stage regenerator tube 31, the cylinder 42 of the second stage regenerator tube 41, the cylinder 37 of the first stage pulse tube 36, and the cylinder 47 of the second stage pulse tube 46 are formed by thin wall stainless steel tubes. Because of this, at the time of operations of the pulse tube cryocooler, the cylinders 32, 42, 37, and 47 are elastically stretched in axial directions (upper and lower directions of FIG. 1) by repeated compression and expansion of the working gas flowing through these tubes so that the first stage cooling stage 30 and the second stage cooling stage 40 connected to the low temperature ends of these cylinders are vibrated.

In addition, due to the vibration, a position of the subject to be cooled provided at each cooling stage is changed. The change of the position of the subject to be cooled may be a problem for a semiconductor manufacturing apparatus requiring positioning with high precision.

On the other hand, in the embodiment of the present invention, the pulse tube cryocooler 100 includes a reinforcing member configured to prevent vibration of the first stage cooling stage 30 and the second stage cooling stage 40. For example, a reinforcing member 51 is provided between the flange 21 and the first stage cooling stage 30 in the example shown in FIG. 1. The reinforcing member 51 has an upper end fixed to the flange 21 and a lower end fixed to the first stage cooling stage 30.

In a case where such a reinforcing member 31 is provided between the flange 21 and the first stage cooling stage 30, vibration of the first stage cooling stage 30 generated due to compression and expansion of the coolant gas flowing inside the pulse tubes and regenerator tubes can be prevented. In addition, because of this, vibration of the second stage cooling stage 40 connected to the first stage cooling stage 30 via the second stage regenerator tube 41 can be prevented.

Accordingly, in the pulse tube cryocooler 100 of the embodiment of the present invention, it is possible to reduce position change that may occur at the subject to be cooled connected to the first stage cooling stage 30 and the second stage cooling stage 40 due to vibration at the cold head part 20.

There is no limitation to a material forming the reinforcing member. Various materials, for example, metal, ceramic such as glass, or organic polymeric material such as plastic, may be used as the material forming the reinforcing member.

In a case where the material forming the reinforcing member has a sufficiently large elastic modulus in tension, rigidity between the flange 21 and the first stage cooling stage 30 is improved by providing the reinforcing member 51. As a result of this, vibration of the first stage cooling stage 30 and the second stage cooling stage 40 can be further prevented.

Furthermore, in a case where the material forming the reinforcing member has a sufficient elastic modulus in tension, thermal loss that may be generated by heat transferring between the reinforcing member and a cold atmosphere of the cold head part 20 is prevented. As a result of this, it is possible to reduce degradation of cooling capacity of a cryocooler that may happen due to providing the reinforcing member.

The inventors of the present invention found that the value "A" expressed by the following formula (1) can be a standard for selecting the material forming the reinforcing member.

$A$=coefficient of thermal conductivity (W/m/K) at a room temperature (25° C.) of the material/elastic modulus in tension (kgf/mm$^2$) at the room temperature (25° C.) of the material [Formula 1]

In addition, the inventors of the present invention also found that in a case where the value "A" of the material is equal to or smaller than the value "A" of the stainless steel (SUS 304 steel), when such a material is used as the reinforcing member, it is possible to reduce the vibration of the first stage cooling stage and the second stage cooling stage without influencing the cooling capacity of the cryocooler. In other words, the material property for using the material as the reinforcing member satisfies the following formula 2.

(The value $A$ of the material)/(the value $A$ of SUS 304 stainless steel)≤1. [Formula 2]

As a material satisfying the formula 2, for example, austenitic or martensitic stainless steel such as SUS 304, SUS 316L, SUS 310S, and SUS 430, GFRP (glass fiber reinforced plastic), CFRP (carbon fiber reinforced plastic), AFRP (aramid fiber reinforced plastic), and SiC-FRP (silicon carbide fiber reinforced plastic) can be used.

The following table 1 shows the values A and "(The value A of the material)/(the value A of SUS 304 stainless steel)" of these materials. As shown in the table 1, it can be found that the ratios "(The value A of the material)/(the value A of SUS 304 stainless steel)" of these materials are extremely smaller than the SUS 304 stainless steel.

TABLE 1

| MATERIAL | COEFFICIENT OF THERMAL CONDUCTIVITY (W/m · K) AT ROOM TEMPERATURE | ELASTIC MODULUS IN TENSION ($kgf/mm^2$) AT ROOM TEMPERATURE | VALUE A [(W · kgf)/(m · K · $mm^2$)] | "VALUE A OF MATERIAL"/ VALUE A OF SUS 304" [—] |
|---|---|---|---|---|
| SUS304 | 15.00 | 20000 | 0.000750 | 1.00 |
| GFRP | 0.30 | 4500 | 0.000067 | 0.09 |
| CFRP | 5.23 | 36500 | 0.000143 | 0.19 |
| AFRP | 0.17 | 7000 | 0.000025 | 0.03 |
| SiCFRP | 0.35 | 15000 | 0.000023 | 0.03 |

By using these materials as a material of the reinforcing member, it is possible to extremely properly prevent the vibration of the first stage cooling stage, the second stage cooling stage, and the subject to be cooled connected to these stages.

[Second Embodiment]

Figure 2:
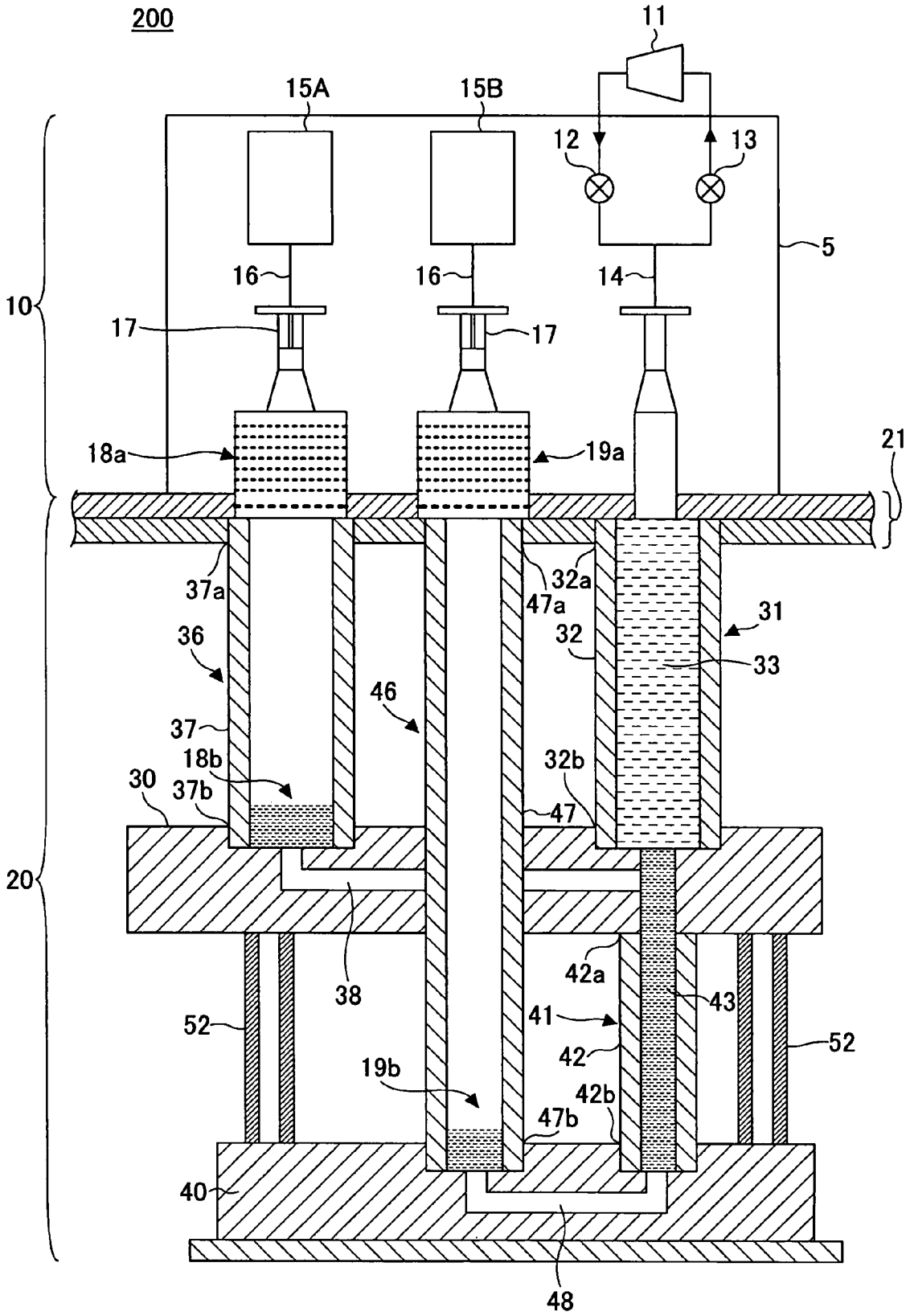
FIG. 2 is a schematic structural view of a two-stage type pulse tube cryocooler of a second embodiment of the present invention.

Next, a second embodiment of the present invention is discussed with reference to FIG. 2. Here, FIG. 2 is a schematic structural view of a two-stage type pulse tube cryocooler of a second embodiment of the present invention.

Basic structural members of the pulse tube cryocooler 200 are the same as those of the pulse tube cryocooler 100 discussed above. Therefore, in FIG. 2, parts that are the same as the parts shown in FIG. 1 are given the same reference numerals, and explanation thereof is omitted.

In the pulse tube cryocooler 200 unlike the pulse tube cryocooler 100 of the first embodiment of the present invention, the reinforcing member 52 is provided between the first stage cooling stage 30 and the second stage cooling stage 40.

The problem of the cooling stage due to the elastic expansion and contraction of the regenerator tube and the pulse tube may be serious at the first stage cooling stage 30 more than the second stage cooling stage 40. This is because the second stage cooling stage 40 compared to the first stage cooling stage 30 is situated far from the flange 21 attached to the cylinders 32, 37, and 47. Therefore, big influence due to this vibration may be generated based on minute expansion and contraction of the cylinders 32, 37, and 47.

However, in the second embodiment of the present invention, by the reinforcing member 52, the vibration of the second stage cooling stage 40 can be reduced to the substantially same level as that of the first stage cooling stage 30. Accordingly, position change generated at the subject to be cooled connected to the second stage cooling stage 40 can be properly prevented.

[Third Embodiment]

Figure 3:
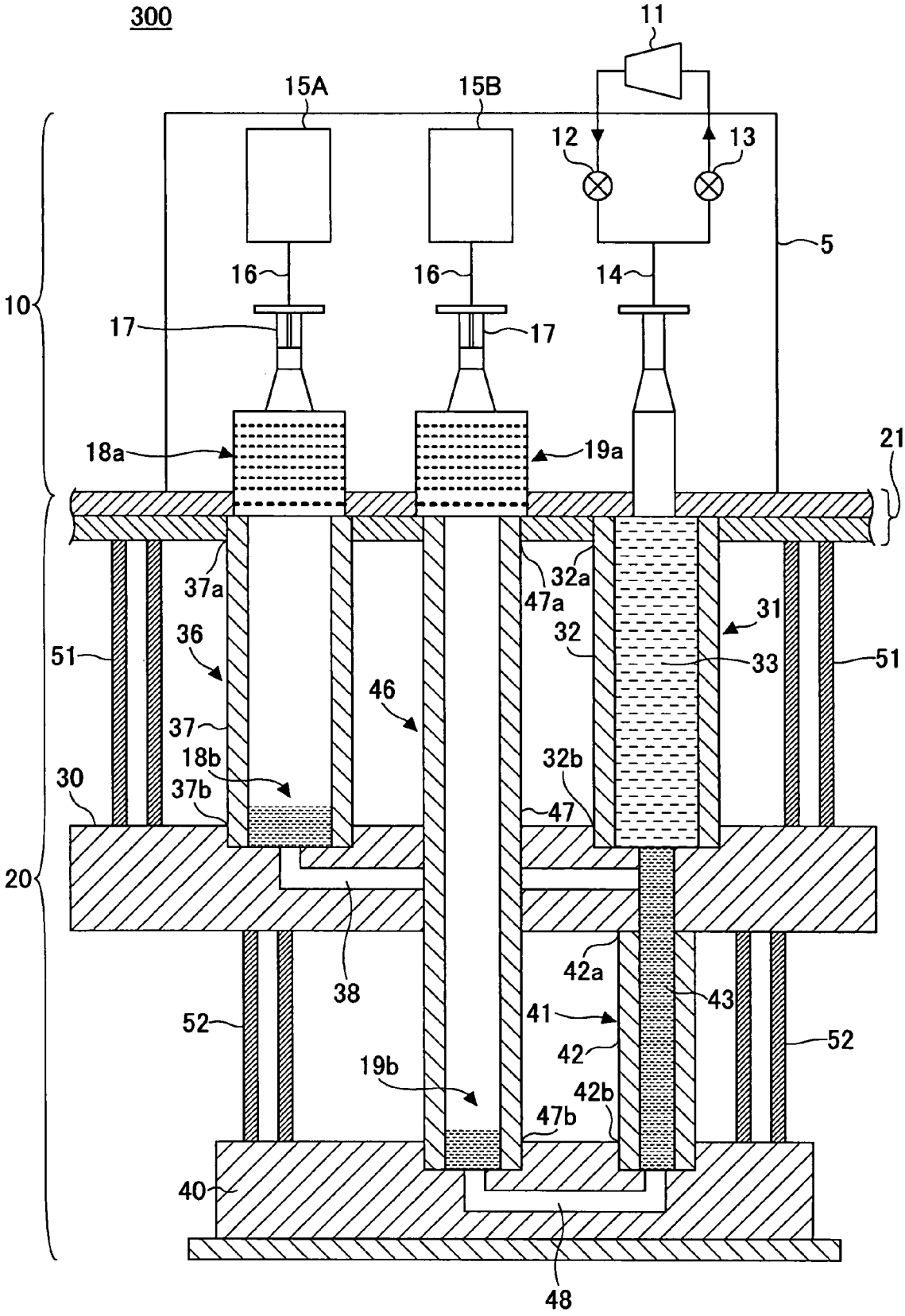
FIG. 3 is a schematic structural view of a two-stage type pulse tube cryocooler of a third embodiment of the present invention.

Next, a third embodiment of the present invention is discussed with reference to FIG. 3. Here, FIG. 3 is a schematic structural view of a two-stage type pulse tube cryocooler of a third embodiment of the present invention.

Basic structural members forming a pulse tube cryocooler 300 are the substantially same as those of the pulse tube cryocooler 100 of the first embodiment of the present invention. Therefore, in FIG. 3, parts that are the same as the parts shown in FIG. 1 are given the same reference numerals, and explanation thereof is omitted.

The structure of the third embodiment of the present invention is formed by combining the first embodiment and the second embodiment. In other words, the pulse tube cryocooler 300 includes reinforcing members 51 and 52. The reinforcing members 51 and 52 are provided between the flange 21 and the first stage cooling stage 30 and between the first stage cooling stage 30 and the second stage cooling stage 40.

Because of providing the reinforcing members 51 and 52 as discussed above, vibration generated at the first stage cooling stage 30 is prevented by the reinforcing member 51 and vibration generated at the second stage cooling stage 40 is prevented by the reinforcing member 52. Accordingly, position change of the subject to be cooled connected to the first stage cooling stage 30 and the second stage cooling stage 40 can be further reduced.

[Fourth Embodiment]

Figure 4:
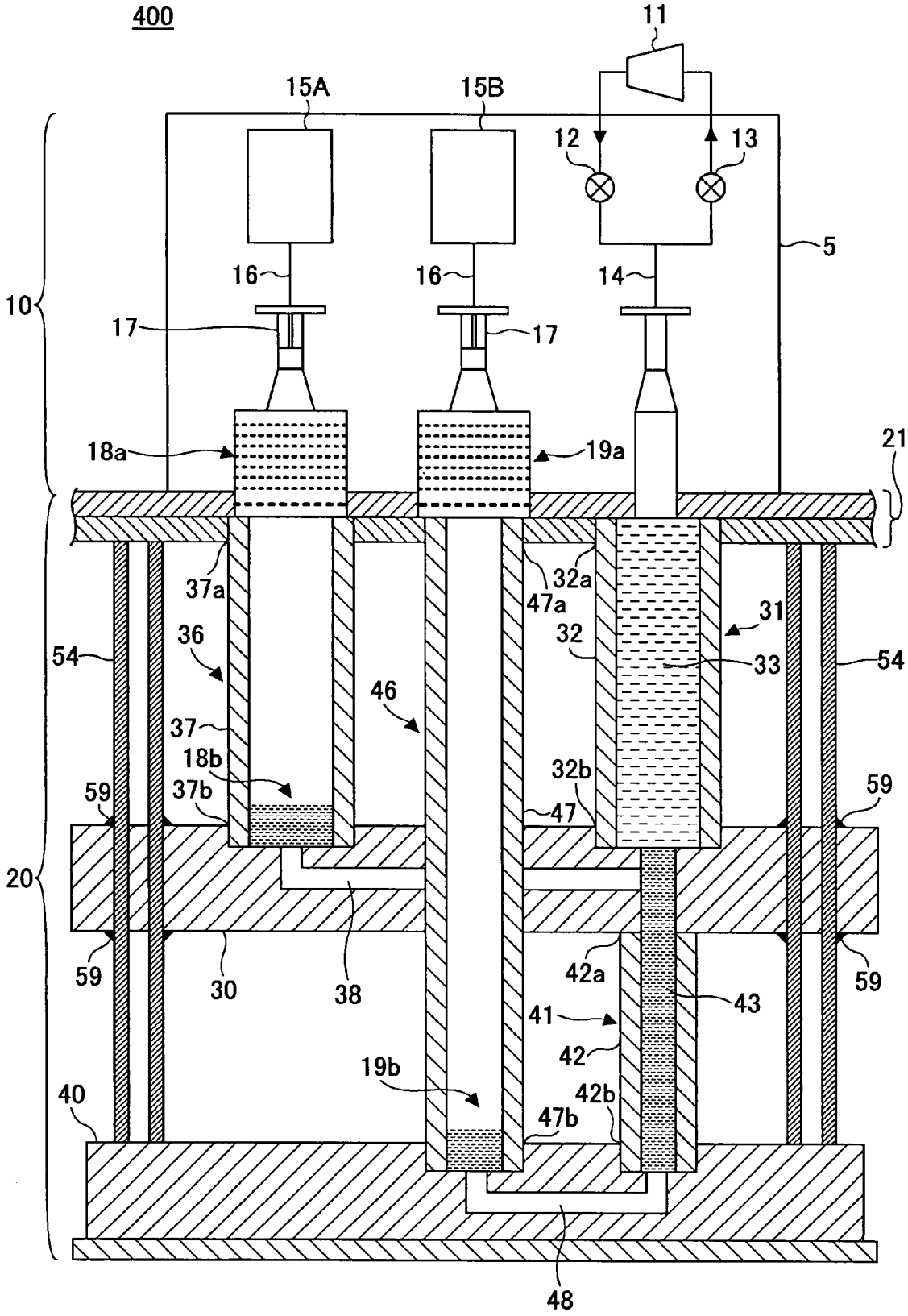
FIG. 4 is a schematic structural view of a two-stage type pulse tube cryocooler of a fourth embodiment of the present invention.

Next, a fourth embodiment of the present invention is discussed with reference to FIG. 4. FIG. 4 is a schematic structural view of a two-stage type pulse tube cryocooler of a fourth embodiment of the present invention.

Basic structural members forming a pulse tube cryocooler 400 are the substantially same as those of the pulse tube cryocooler 300 of the third embodiment of the present invention. Therefore, in FIG. 4, parts that are the same as the parts shown in FIG. 3 are given the same reference numerals, and explanation thereof is omitted.

In this embodiment, the pulse tube cryocooler 400 is different from the pulse tube cryocooler 300 shown in FIG. 3 in that a reinforcing member 54 of the pulse tube cryocooler 400 extends from the flange 21 to the second stage cooling stage 40. In other words, the reinforcing member 54 pierces the first stage cooling stage 30. The upper end of the reinforcing member 54 is fixed to the flange 21 and the lower end of the reinforcing member 54 is fixed to the second stage cooling stage 40.

The reinforcing member 54 and the first stage cooling stage 30 are fixed to each other at a connection part 59 by, for example, a method of periphery welding of the reinforcing member 54.

In the meantime, the two-stage pulse tube cryocoolers are discussed in the above-discussed embodiments. However, the present invention is not limited to these embodiments. The present invention can be applied to, for example, a single-stage pulse tube cryocooler or a multiple-stage such as three-stage pulse tube cryocooler. An example where the present invention is applied to the single-stage pulse tube cryocooler is discussed in the following embodiment.

[Fifth Embodiment]

Figure 5:
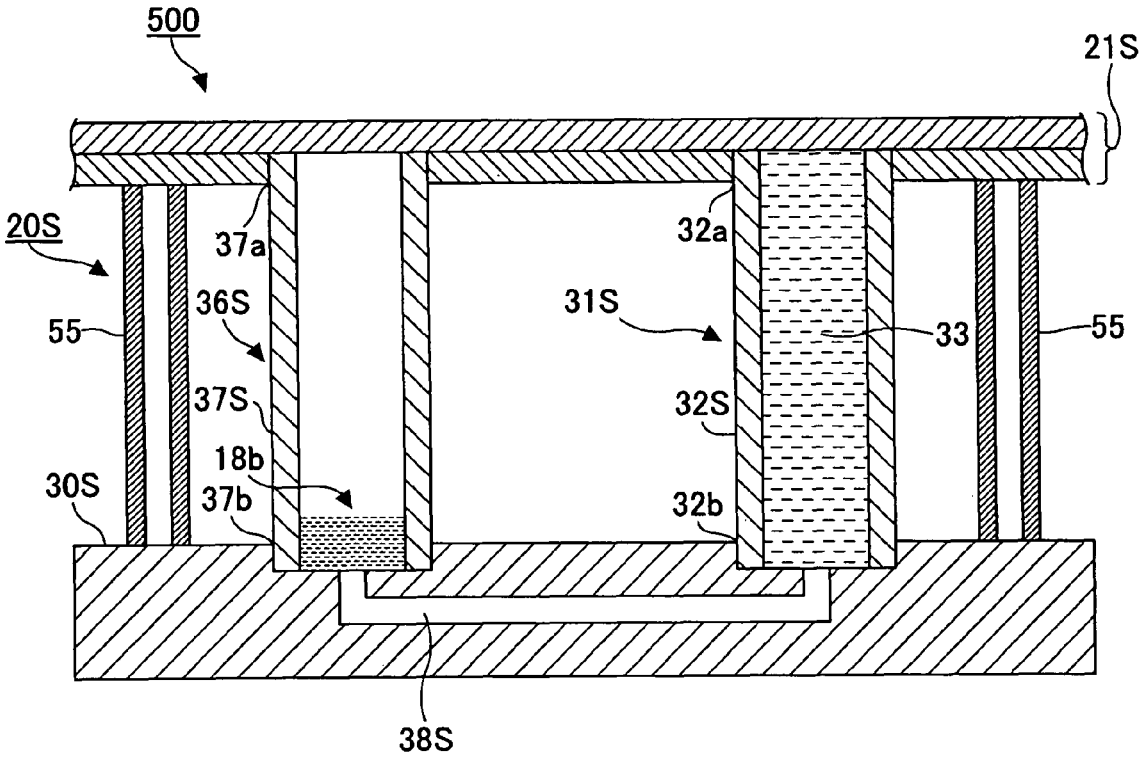
FIG. 5 is a schematic structural view of a single-stage type pulse tube cryocooler of a fifth embodiment of the present invention.

Next, a fifth embodiment of the present invention is discussed with reference to FIG. 5. FIG. 5 is a schematic structural view of a single-stage type pulse tube cryocooler of a fifth embodiment of the present invention.

A single-stage pulse tube cryocooler 500 is used in the fifth embodiment. For the convenience of illustration, only a flange 21A and a cold head part 20S of the singe-stage pulse tube cryocooler 500 are shown in FIG. 5.

The cold head part 20S includes a regenerator tube 31S, a pulse tube 36S and a cooling stage 30S. The structures and functions of the regenerator tube 31S, the pulse tube 36S and the cooling stage 30S are the same as those of the first stage regenerator tube 31, the first stage pulse tube 36, and the first stage cooling stage 30 of the two-stage pulse tube cryocooler 100.

A reinforcing member 55 is provided at the cold head part 20S. The upper end of the reinforcing member 55 is fixed to the flange 21A and the lower end of the reinforcing member 55 is fixed to the cooling stage 30S. In this embodiment, vibration of the cooling stage 30S is prevented by the reinforcing member 55 so that position change of the subject to be cooled provided at the cooling stage 30S can be reduced.

While the reinforcing members 51, 52, 54, and 55 are discussed as hollow tube members, the reinforcing members may have other configurations such as stick members. In addition, the number of the reinforcing member is not limited to two but may be one or equal to or greater than three. For example, in a case where a single reinforcing member is provided between the flange and the cooling stage, the reinforcing member may be provided in a designated position of the cooling stage so that center of gravity of the cooling stage is situated in the center part.

It is normal practice that ends of the pulse tube and the regenerator tube are fixed to the cooling stage. However, the fixing positions seen from an upper part are not symmetric. In other words, the center of gravity of the cooling stage is offset from the center part. However, in a case where the single reinforcing member is provided as discussed above so that the center of gravity of the cooling stage is offset from the center part, the cooling stage is well balanced so that the vibration of the cooling stage can be further reduced.

In addition, the reinforcing member may be formed as a single hollow cylindrical tube having a large internal diameter so that entire pulse tube and the regenerator tube can be surrounded by the reinforcing member and the reinforcing member may be provided between the flange and the cooling stage 30.

In the above-discussed embodiments, the pulse tube cryocooler such as the two-stage pulse tube cryocooler is discussed. However, the present invention is not limited to these embodiments. The present invention can be applied to other regenerative cryocooler, such as a GM (Gifford-McMahon) cryocooler, having a cooling stage connected to a cylinder member where coolant gas with repeating expansion and compression flows.

In a case where the present invention is applied to the GM (Gifford-McMahon) cryocooler, the above-discussed reinforcing member is provided between the cooling stage and a flange configured to support a cylinder having a regenerative material and a displacer that can reciprocate. Because of this, it is possible to reduce the vibration of the cooling stage and the position change of the subject to be cooled connected to the cooling stage.

EXAMPLE

Next, an example of the embodiments of the present invention is discussed.

The inventors of the present invention have evaluated vibration of the cooling stage, by simulation, with respect to a two-stage pulse tube cryocooler having the reinforcing member (hereinafter "cryocooler of the present invention") and a two-stage pulse tube cryocooler not having the reinforcing member (hereinafter "conventional cryocooler").

It is assumed that the cryocooler of the present invention has the structure shown in FIG. 3. In other words, the cryocooler of the present invention includes the first reinforcing member provided between the flange and the first stage cooling stage and the second reinforcing member provided between the first stage cooling stage and the second stage cooling stage. On the other hand, the conventional cryocooler has a structure shown in FIG. 3 without the reinforcing member.

In the simulation, following assumption is made.

That is, four first reinforcing members having hollow tube configurations and made of GFRP (glass fiber reinforced plastic) are provided between the flange and the first stage cooling stage. Each of these reinforcing members is arranged in four positions having the same distance in radial directions from the center on two straight lines passing through the center of the first stage cooling stage and being perpendicular to each other.

Accordingly, as seen from the upper part of the first stage cooling stage, the reinforcing members are situated in positions symmetric in upper, lower, left and right directions.

Two of second reinforcing members having hollow tube configurations and made of GFRP (glass fiber reinforced plastic) are provided between the first stage cooling stage and the second stage cooling stage. These two reinforcing members are arranged in positions having the same distance in radial directions from the center of the second stage cooling stage. A line passing through positions of the reinforcing members and the center position of the second stage cooling stage is arranged on a single straight line.

The following table 2 shows external diameters, thickness, and length of the first reinforcing member and the second reinforcing member used for the simulation.

TABLE 2

| | CRYOCOOLER OF THE PRESENT INVENTION (HAVING REINFORCING MEMBER) | | CONVENTIONAL CRYOCOOLER (NOT HAVING REINFORCING MEMBER) | |
|---|---|---|---|---|
| POSITION OF REINFORCING MEMBER | FLANGE~FIRST STAGE COOLING STAGE | FIRST STAGE COOLING STAGE~SECOND STAGE COOLING STAGE | FLANGE~FIRST STAGE COOLING STAGE | FIRST STAGE COOLING STAGE~SECOND STAGE COOLING STAGE |
| MATERIAL OF REINFORCING MEMBER | GFRP | GFRP | — | — |
| THE NUMBER OF REINFORCING MEMBER | 4 | 2 | — | — |
| DIAMETER OF REINFORCING MEMBER (mm) | 15.5 | 15.5 | — | — |
| THICKNESS OF REINFORCING MEMBER (mm) | 5.5 | 5.5 | — | — |

TABLE 2-continued

| | CRYOCOOLER OF THE PRESENT INVENTION (HAVING REINFORCING MEMBER) | | CONVENTIONAL CRYOCOOLER (NOT HAVING REINFORCING MEMBER) | |
|---|---|---|---|---|
| LENGTH OF REINFORCING MEMBER (mm) | 132 | 175 | — | — |
| VIBRATION DEFORMATION OF COOLING STAGE (μm) | ±1.7 (FIRST STAGE) | ±2.6 (SECOND STAGE) | ±2.8 (FIRST STAGE) | ±3.2 (SECOND STAGE) |

The result of the simulation is indicated at the bottom part of the table 2. As shown in table 2, the vibration deformations of the first stage cooling stage and the second stage cooling stage in the conventional cryocooler are ±2.8 μm and ±3.2 μm, respectively. On the other hand, the vibration deformation of the first stage cooling stage and the second stage cooling stage in the cryocooler of the embodiment of the present invention are ±1.7 μm and ±2.6 μm, respectively.

The "vibration deformation" means a maximum deformation range in a vertical direction of the position of the cooling stage at the time of vibration (for example, at the time when the cryocooler works) compared to the position of the cooling stage at the time of resting (for example, at the time when the cryocooler stops working). The symbols of "+" and "−" indicate extension and construction, respectively, of the center position of the cooling stage.

Based on this result of the simulation, it is found that vibration is prevented at the first stage cooling stage and the second stage cooling stage by providing the reinforcing member at the two-stage type pulse tube cryocooler.

According to the above-discussed embodiment of the present invention, it is possible to provide a regenerative cryocooler, the regenerative cryocooler being connected to a compressor configured to make coolant gas have a high pressure, send the high pressure coolant gas, and absorb coolant gas having a low pressure, the regenerative cryocooler including a cooling stage having a regenerative material and connected to a cylinder member, the cylinder member being where the coolant gas flows, the coolant gas repeating compression and expansion; and a reinforcing member configured to prevent vibration of the cooling stage.

The reinforcing member may be made of a material satisfying the following formula, wherein "A" is expressed as "A=coefficient of thermal conductivity (W/m/K) at a room temperature (25° C.) of the material/elastic modulus in tension (kgf/mm$^2$) at the room temperature (25° C.) of the material"

(The value $A$ of the material)/(the value $A$ of SUS 304 stainless steel)≤1. [Formula]

The reinforcing member may include a material selected from a group consisting of stainless steel, GFRP (glass fiber reinforced plastic), CFRP (carbon fiber reinforced plastic), AFRP (aramid fiber reinforced plastic), and SiC-FRP (silicon carbide fiber reinforced plastic).

According to the above-discussed embodiment of the present invention, it is also possible to provide a pulse tube cryocooler, including: a compressor configured to make coolant gas have a high pressure, send the high pressure coolant gas, and absorb coolant gas having a low pressure; a pulse tube where the coolant gas flows, the coolant gas repeating compression and expansion; and a reinforcing member configured to prevent vibration of a cooling stage connecting a regenerator tube and the pulse tube.

The pulse tube cryocooler may further include a flange where one end of the pulse tube is connected, wherein the reinforcing member may be provided between the flange and the cooling stage. The pulse tube cryocooler may be a two-stage pulse tube cryocooler having a first stage cooling stage and a second stage cooling stage provided in this order from a side nearer to the flange, and the reinforcing member may be provided at least at one of between the flange and the first stage cooling stage and between the first stage cooling stage and the second stage cooling stage. One end of the reinforcing member may be connected to the flange and another end of the reinforcing member is connected to the second stage cooling stage. The reinforcing member may be made of a material satisfying the following formula, wherein "A" is expressed as "A=coefficient of thermal conductivity (W/m/K) at a room temperature (25° C.) of the material/elastic modulus in tension (kgf/mm$^2$) at the room temperature (25° C.) of the material"

(The value $A$ of the material)/(the value $A$ of SUS 304 stainless steel)≤1. [Formula]

The reinforcing member may include a material selected from a group consisting of stainless steel, GFRP (glass fiber reinforced plastic), CFRP (carbon fiber reinforced plastic), AFRP (aramid fiber reinforced plastic), and SiC-FRP (silicon carbide fiber reinforced plastic).

Thus, the embodiments of the present invention can provide a regenerative cryocooler, such as a pulse tube cryocooler, whereby good cooling capacity can be achieved and vibration of a cooling stage can be prevented without making it complex and large.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

The present invention can be applied to a regenerative cryocooler applied to a low temperature system such as an NMR (nuclear magnetic resonance) diagnostic apparatus, a superconducting magnet apparatus, or a cryopump, for example, a singe-stage type or a multiple stage type pulse tube cryocooler and a GM (Gifford-McMahon) cryocooler.

This patent application is based on Japanese Priority Patent Application No. 2007-123629 filed on May 8, 2007, the entire contents of which are hereby incorporated by reference.

What is claimed is:

1. A regenerative cryocooler, the regenerative cryocooler being connected to a compressor configured to make coolant gas have a high pressure, sending the high pressure coolant gas, and absorbing coolant gas having a low pressure, the regenerative cryocooler comprising:

a cooling stage extending along and about a central axis and directly connected to a hollow cylinder member having a regenerative material contained therein, the cylinder member being where the coolant gas flows, the coolant gas repeating compression and expansion;

two reinforcing members configured to prevent vibration of the cooling stage with respect to a stationary subject to be directly cooled by the cooling stage; and a flange extending along and about the central axis and disposed apart from and facially opposing the cooling stage with the hollow cylinder connected to and between the flange and the cooling stage, wherein, each one of the reinforcing members is formed as a hollow tube or a solid rod, one end of each reinforcing member is directly connected to the flange and the other opposite end of each reinforcing member is connected to the cooling stage, respective ones of the two reinforcing members are disposed on opposite sides of the central axis as viewed in elevation and equidistantly therefrom with the hollow cylinder positioned between the two reinforcing members and the two reinforcing members extend substantially along the entire length of the hollow cylinder member between the flange and the cooling stage.

2. The regenerative cryocooler as claimed in claim 1, wherein the reinforcing member is made of a material satisfying the following formula, wherein "A" is expressed as "A =coefficient of thermal conductivity (W/m/K) at a room wherein "A is as "A=coefficient of thermal conductivity (W/m/K) at a room temperature (25° C.) of the material/elastic modulus in tension (kgf/mm$^2$) at room temperature (25° C.) of the material"

(The value *A* of the material)/(the value *A* of *SUS* 304 stainless steel)≤1. [Formula]

3. The regenerative cryocooler as claimed in claim 1, wherein the reinforcing member includes a material selected from a group consisting of stainless steel, GFRP (glass fiber reinforced plastic), CFRP (carbon fiber reinforced plastic), AFRP (aramid fiber reinforced plastic), and SiC-FRP (silicon carbide fiber reinforced plastic).

4. A regenerative cryocooler as claimed in claim 1, wherein the plurality of reinforcing members are disposed such that the center of gravity of the cooling stage is positioned at the center of the cooling stage.

5. A pulse tube cryocooler, comprising:

a compressor configured to make coolant gas have a high pressure, sending the high pressure coolant gas, and absorbing coolant gas having a low pressure;

a pulse tube where the coolant gas flows, the coolant gas repeating compression and expansion, the pulse tube extending along and about a central axis;

two reinforcing members configured to prevent vibration of a cooling stage with respect to a stationary subject to be directly cooled by the cooling stage, the cooling stage directly connecting a regenerator tube and the pulse tube, the cooling stage extending along and about the central axis, the regenerator tube extending parallel to the pulse tube and being disposed offset therefrom and a flange extending along and about the central axis and disposed apart from and facially opposing the cooling stage with the regenerator tube and the pulse tube connected to and between the flange and the cooling stage, wherein, each one of the reinforcing members being formed as a hollow tube or a solid rod, one end of each reinforcing member is directly connected to the flange and the other opposite end of each reinforcing member is connected to the cooling stage, respective ones of the two reinforcing members are disposed on opposite sides of the central axis as viewed in elevation and equidistantly therefrom with the regenerator tube and the pulse tube positioned between the two reinforcing members and the two reinforcing members extend substantially along the entire length of the regenerator tube and the pulse tube between the flange and the cooling stage.

6. The pulse tube cryocooler as claimed in claim 5, wherein the pulse tube cryocooler is a two-stage pulse tube cryocooler having a first stage cooling stage and a second stage cooling stage disposed apart from the first stage cooling stage, and the reinforcing member is provided at least at one of between the flange and the first stage cooling stage and between the first stage cooling stage and the second stage cooling stage.

7. The pulse tube cryocooler as claimed in claim 6, wherein one end of the reinforcing member is connected to the flange and another end of the reinforcing member is connected to the second stage cooling stage.

8. The pulse tube cryocooler as claimed in claim 5, wherein the reinforcing member is made of a material satisfying the following formula, wherein "A is as "A=coefficient of thermal conductivity (W/m/K) at a room temperature (25° C.) of the material/elastic modulus in tension (kgf/mm$^2$) at room temperature (25° C.) of the material"

(The value *A* of the material)/(the value *A* of *SUS* 304 stainless steel)≤1. [Formula]

9. The pulse tube cryocooler as claimed in claim 5, wherein the reinforcing member includes a material selected from a group consisting of stainless steel, GFRP (glass fiber reinforced plastic), CFRP (carbon fiber reinforced plastic), AFRP (aramid fiber reinforced plastic), and SiC-FRP (silicon carbide fiber reinforced plastic).

10. A cryocooler, comprising:

a cooling stage extending along a central axis and radially therefrom;

a flange extending along and radially about the central axis and disposed apart from the cooling stage in a facially opposing relationship;

a pulse tube extending parallel to the central axis and connected to and between the flange and the cooling stage;

a regenerator tube extending parallel to the central axis and connected to and between the flange and the cooling stage with the cooling stage providing fluid communication between the pulse tube and the regenerator tube; and a first pair of reinforcing members extending parallel to the central axis and connected to and between the flange and the cooling stage, one of the first pair of reinforcing members disposed adjacent to and radially outwardly from the regenerator tube, a remaining one of the first pair of reinforcing members disposed adjacent to and radially outwardly from the pulse tube, the first pair of reinforcing members being disposed on opposite sides of the central axis as viewed in elevation, respective ones of the first pair of reinforcing members being disposed apart from the central axis at a same first distance therefrom, wherein the first pair of reinforcing members are configured to prevent vibration of the cooling stage with respect to a stationary subject to be directly cooled by the cooling stage and the first pair of reinforcing members extend substantially along the entire length of the regenerator tube between the flange and the cooling stage.

11. A cryocooler according to claim 10, further comprising a second pair of reinforcing members, respective ones of the second pair of reinforcing members being disposed radially outwardly from respective ones of the first pair of reinforcing members, respective ones of the second pair of reinforcing members being disposed apart from the central axis at a same second distance therefrom.

* * * * *